US007487574B2

(12) United States Patent
Lee-Holowka et al.

(10) Patent No.: US 7,487,574 B2
(45) Date of Patent: Feb. 10, 2009

(54) EYEGLASS AND OTHER PERSONAL ITEMS HOLDER

(76) Inventors: Janice Lee-Holowka, 20 Dyers Lane, London (GB) SW15 6JR; Patricia Lee, 530 Park Ave., Apt. 5G, New York, NY (US) 10021; Marc Lester, 530 Park Ave., Apt. 5G, New York, NY (US) 10021

( * ) Notice: Subject to any disclaimer, the term of this patent is extended or adjusted under 35 U.S.C. 154(b) by 54 days.

(21) Appl. No.: 11/392,560

(22) Filed: Mar. 30, 2006

(65) Prior Publication Data

US 2007/0226957 A1 Oct. 4, 2007

(51) Int. Cl.
*A44B 21/00* (2006.01)
*A45F 5/02* (2006.01)

(52) U.S. Cl. ..... 24/3.13; 24/3.1; 24/3.8; 2/1; 224/251; 224/269

(58) Field of Classification Search ..... 24/3.3, 24/3.13, 3.4, 3.8; 224/269, 251; 2/1
See application file for complete search history.

(56) References Cited

U.S. PATENT DOCUMENTS 2,284,069 A * 5/1942 Robertson ..... 224/258
2,297,661 A * 9/1942 Okun ..... 24/3.13
2,457,195 A * 12/1948 Bagnall, Jr. ..... 24/3.13
2,572,889 A * 10/1951 Strykower ..... 224/258
4,894,887 A 1/1990 Ward, II
4,991,236 A * 2/1991 Pritchett ..... 2/195.8
5,033,612 A 7/1991 Bivins
5,351,098 A 9/1994 McDaniels et al.
5,394,592 A * 3/1995 Quick ..... 24/16 R
5,491,878 A 2/1996 Janouschek
5,551,126 A 9/1996 Wallo
5,860,191 A 1/1999 Sieger
5,893,198 A 4/1999 DeCotis
5,956,812 A 9/1999 Moennig
2004/0149795 A1 * 8/2004 Szarek ..... 224/607

* cited by examiner

*Primary Examiner*—Robert J Sandy
(74) *Attorney, Agent, or Firm*—Darby & Darby, P.C.

(57) ABSTRACT

A holder for securing eyeglasses, sunglasses or other personal items that may be securely incorporated into an article of clothing at the time the article is manufactured. The holder includes a base member that can be inserted into an article of clothing. The base member can be securely attached to an interconnecting cord. The cord may have one end threaded through the article of clothing and securely affixed to the base member and the other end securely affixed to the external part of the holder. The external part of the holder can include a hanger with a support base and a loop. The holder allows a wearer to insert a temple piece of a pair of eyeglasses, or a hook attached to another personal item, through the loop and allows the item to assume a secure and relatively flat position against the wearer's body.

34 Claims, 3 Drawing Sheets

EYEGLASS AND OTHER PERSONAL ITEMS HOLDER

BACKGROUND OF THE INVENTION

1. Field of the Invention

This invention relates to a holder for personal items, and more particularly, to an eyeglass holder that can be incorporated into an article of clothing, preferably at the time the article of clothing is manufactured.

2. Description of Related Art

Eyeglass holders have generally comprised a case or pouch for storing unworn eyeglasses, which the user normally carries in a pocket, purse or pouch. Some types of eyeglass holders have been in the form of a cord or decorative necklace with loops at the opposite ends of the cord for receiving a temple piece of the eyeglasses, which may be worn around the user's neck.

Other versions of eyeglass holders that are purchased separately and are temporarily attached by the user to an article of clothing are disclosed in U.S. Pat. Nos. 5,551,126; 5,491,878; 5,956,812; 5,033,612; 4,894,887; 5,351,098; 5,860,191; and 5,893,198. Eyeglass holders of the type disclosed in U.S. Pat. No. 5,551,126 require that the user attach a hanger to an article of clothing using a button that is sewn onto the front of a garment. Eyeglass holders of the type disclosed in U.S. Pat. Nos. 5,491,878 and 5,956,812 use a clip or a clamp for fastening a receiver and a holder to the desired article of clothing. Eyeglass holders of the type disclosed in U.S. Pat. No. 5,033,612 utilize a removable non-clip pin, which requires the user to perforate the garment at each wearing. Eyeglass holders of the type disclosed in U.S. Pat. Nos. 4,894,887, 5,351,098 and 5,860,191 use a non-spring tension-dependent folding type clip or a combination of a clothespin type holder and a spring clip. An eyeglass holder of the type disclosed in U.S. Pat. No. 5,893,198 uses a pivotal swivel holder that embodies an ornamental necklace, which is worn around the user's neck.

The prior art eyeglass holders may require the user to purchase a discrete holder or multiple discrete holders, which may alter the design of an article of clothing, damage the fabric and damage the temple piece of the eyeglass. Moreover, these designs may require the user to not only purchase the holder(s) separately from the article of clothing, but also to attach the holder to the garment, often at each wearing. Additionally, certain designs may limit to a certain thickness the garment to which the holder may be attached. Accordingly, there exists a need for a simple, ready-made and design-incorporated type of eyeglass or other personal item holder that can be securely affixed to an article of clothing, preferably at the time of its manufacture, to resist the unintentional separation of the holder from the article of clothing.

SUMMARY OF THE INVENTION

An embodiment of the invention relates to a holder for supporting a personal item comprising a base member having a first throughhole therethrough, a cord having a first end inserted through the first throughhole and a hanger comprising a loop and a support base connected to the loop. The support base may be affixed to a second end of the cord and the base member may be adapted to be inserted into or attached on an article of clothing. The loop may be adapted to support the personal item thereon. The term personal item may include, by way of examples, eyeglasses, sunglasses, a media player such as an iPOD or a mobile phone.

Preferably, the cord is rotatably mounted. Preferably, a closure device is affixed to the rotatably mounted cord to prevent the rotatably mounted cord from sliding out of the first throughhole. Preferably, the base member is rectangular in shape. In another embodiment, the base member is shaped to conform to a desired space in an article of clothing.

In one embodiment, the first throughhole may be located in any portion of the base member. Preferably, the support base has a second throughhole centered lengthwise and crosswise on the support base and the rotatably mounted cord preferably passes through the second throughhole in a direction substantially perpendicular to the support base. Preferably, the first and second throughholes have a diameter greater than the rotatably mounted cord.

In one embodiment, the support base comprises a resilient tubular ring or cylinder having a diameter greater than the loop. In one embodiment, the support base comprises transparent material or material of any color. Preferably, the loop is a covered fabric elastic loop approximately 0.5" in diameter extending to approximately 1.5" when fully extended. Preferably, the loop is made of formed resilient materials such as metal, fabric or plastic. In one embodiment, the loop comprises transparent material or material of any color. Preferably, the loop is formed to accommodate a temple piece of an eyeglass or a hook attached to another personal item. In one embodiment, the loop is shaped to resemble a manufacturer's logo or other ornamental shape.

In one embodiment, the rotatably mounted cord is looped through a needle to facilitate the perforation of a garment without damaging the fabric and to facilitate threading through the base member. Preferably, the rotatably mounted cord comprises metallic, plastic or fabric wire, cable, line or twine.

Preferably, the holder further comprises a resilient closure for securely affixing the base member to the hanger. Preferably, the base member comprises resilient fabric, plastic or metal material. Preferably, the support base comprises resilient fabric, plastic or metal material. In one embodiment, the support base is shaped to resemble a manufacturer's logo or other ornamental shape. In another embodiment, the base member comprises transparent material or material of any color.

Preferably, the closure device is rectangular and greater in size than the first throughhole in the base member. In one embodiment, the closure device is shaped to resemble substantially a clip such as that tie-pin and is greater in size than the first throughhole in the base member. In one embodiment, the closure device is a knot in the cord that is greater in size than the first throughhole in the base member.

Yet another embodiment relates to a method of manufacturing a holder comprising a hanger comprising a loop and a support base connected to the loop, the method comprising affixing a first end of a rotatably mounted cord to a base member; affixing a second end of the rotatably mounted cord to the support base; and affixing the base member into or on an article of clothing during manufacture of the article of clothing, wherein the loop is adapted to support a personal item thereon. Preferably, said providing a rotatably mounted cord having a first end further comprises affixing a closure device to the rotatably mounted cord. The method could further comprise affixing the rotatably mounted cord via a throughhole in said support base;passing said rotatably mounted cord through an article of clothing; and securing said base member to said article of clothing. Preferably, the rotatably mounted cord is looped with a needle through the article of clothing without damaging the article of clothing and facilitating threading through the base member. Preferably, said affixing said first end of said rotatably mounted cord to said base member comprises traversing the first end of said rotatably mounted cord through a through hole in the base member. Preferably, said affixing said first end of said rotatably mounted cord to said base member comprises attaching the first end of said rotatably mounted cord to the base member.

Additional advantages of this invention will become readily apparent to those skilled in this art from the following detailed description, wherein only the preferred embodiment of this invention is shown and described, simply by way of illustration of the best mode contemplated for carrying out this invention. The drawings and description are to be regarded as illustrative in nature and not as restrictive.

BRIEF DESCRIPTION OF THE DRAWINGS

These and other features, aspects and advantages of the present invention will become better understood with regard to the following description, appended claims and accompanying drawings where:

For purposes of clarity and brevity, like elements and components will bear the same designations and numbering throughout the Figures.

DETAILED DESCRIPTION OF THE INVENTION

An embodiment of this invention can be to provide a holder that is inherently simple in construction and inexpensive to manufacture, and is convenient in operation for the wearer.

Another embodiment of this invention can be to provide a holder that is incorporated into or attached on and securely affixed to an article of clothing, preferably at the time of the article's manufacture.

Another embodiment of this invention can be to provide a holder that can be relatively unobtrusive, or, alternatively, in the form of a manufacturer's logo, depending on the desired design of the article of clothing.

Another embodiment of this invention can be to provide a holder that can be readily and securely affixed to any part of an article of clothing, such as a pocket, placket band, sleeve, collar or belt loop without damaging the fabric or altering the design of the garment.

Another embodiment of this invention can be to provide a holder with an elastic loop that is sufficiently flexible to accommodate a wide range of thicknesses of temple pieces of eyeglasses and can pivotally rotate to firmly secure the eyeglasses to resist an unintentional separation of the eyeglasses from the holder.

Another embodiment of this invention can be to provide a holder with an elastic or resilient loop that can accommodate a hook attached to another type of personal item and can pivotally rotate to firmly secure the item to resist an unintentional separation of the item from the holder.

The foregoing embodiments and other features and advantages are attained by a holder having a base member that is simple in construction and can be readily, unobtrusively and inexpensively inserted into or attached on an article of clothing, preferably at the time of the article's manufacture, to firmly secure the holder to the garment. The base member may be securely attached through a throughhole to a cord having one end threaded through the article of clothing and securely affixed to the base member and the other end securely affixed to the external part of the holder. The external part of the holder can include a hanger, itself comprised of a support base, and in one embodiment, a flexible elastic loop in the shape of a circle or oval. This flexible elastic loop can be made in various sizes, with one embodiment being approximately 0.5" and extending up to approximately 1.5" when the elastic is fully extended. Both the support base and the loop can also be customized to embody a manufacturer's logo. The hanger is designed so that the user can insert the temple piece of a pair of eyeglasses, or a hook attached to another type of personal item. The eyeglasses or other personal item can then assume a flat position relative to the person's body. This design can also provide for a pivotal rotation to resist the unintentional separation of the eyeglasses or other item from the holder, even as the user moves.

Figure 1:
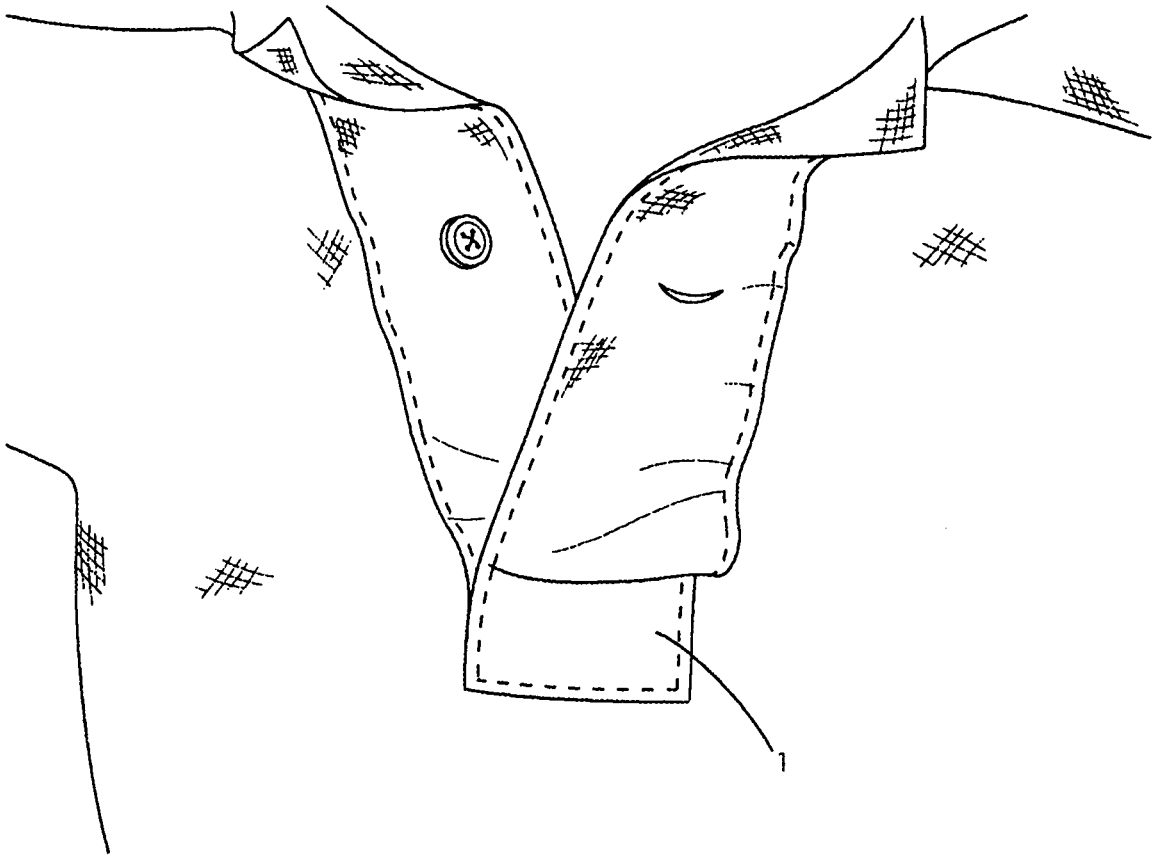
Fig. 1 (Prior Art)
FIG. 1 shows a perspective view of the front of a typical golf shirt (prior art).

FIG. 1 shows a golf shirt of familiar design. Such a design typically has a generally rectangular-shaped area 1 at the bottom of the front closure where garment material is folded and sewn together.

Figure 2:
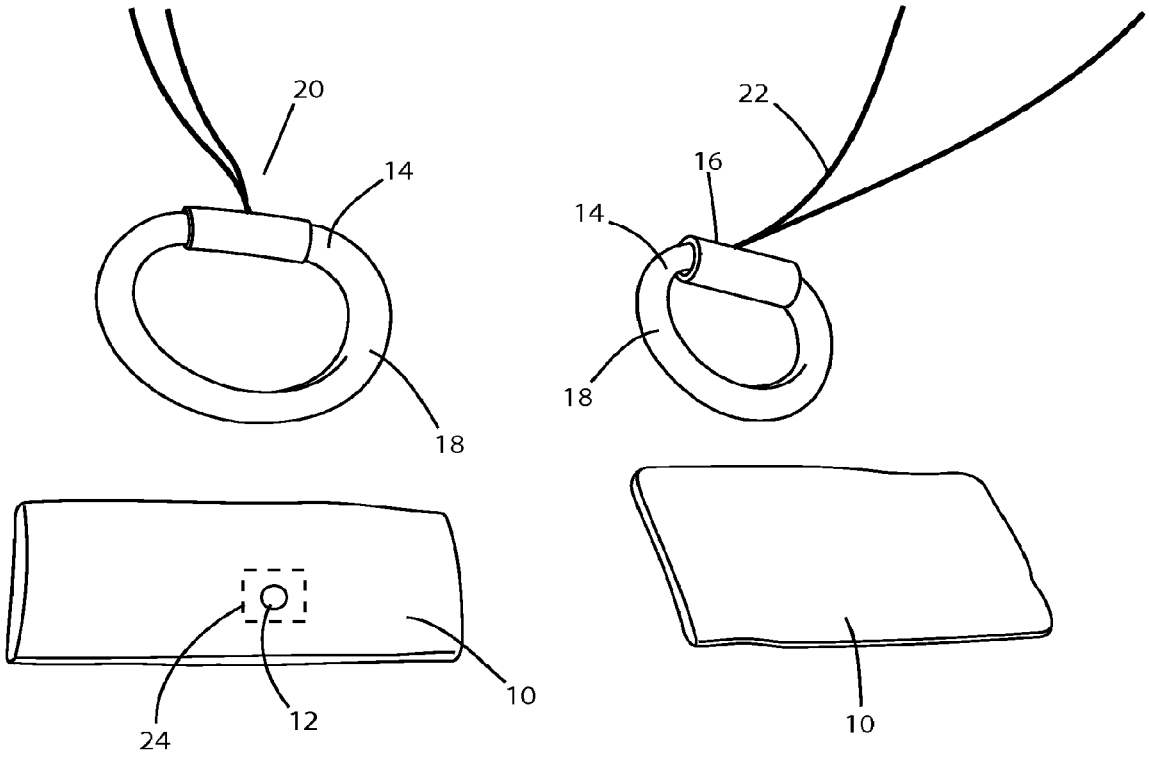
FIG. 2 shows a perspective view of one embodiment of the holder according to the present invention.

FIG. 2 shows an example of one embodiment of the eyeglass or other personal items holder. In FIG. 2, the holder comprises a base member 10 with a first throughhole 12. The base member 10 may be rectangular or shaped to conform to the desired space in an article of clothing, such as the generally rectangular-shaped area 1 shown in FIG. 1. The base member 10 may be made of transparent material, or material of any color. Suitable materials for base member 10 may be resilient fabric, plastic or metal. The first throughhole 12 may be located in any portion of the base member 10.

The holder also has hanger 14 comprising a support base 16, which connects to a loop 18. The support base 16 may include a resilient tubular ring or cylinder having a diameter greater than the loop 18 to affix to loop 18. Loop 18 may be formed to accommodate the temple piece of an eyeglass or a hook attached to another personal item. Loop 18 may be made of transparent material or material of any color. Suitable materials for loop 18 may be resilient materials such as metal, fabric or plastic. Loop 18 may be a covered fabric elastic loop, preferably around 0.5" in diameter extending to around 1.5" when fully extended. The support base 16 may be made of transparent material, or material of any color. Suitable materials for support base 16 may be resilient fabric, plastic or metal. The support base 16 and loop 18 may be shaped to resemble a manufacturer's logo or other ornamental shape.

Connected to the support base 16 through a second throughhole 20 is a cord 22 having one end that is securely affixed to the support base 16, and threaded through the first throughhole 12 in the base member 10 on the other end. The second throughhole 20 may be centered lengthwise and crosswise on the support base 16 to allow cord 22 to pass through the second throughhole 20 in a direction substantially perpendicular to the support base 16. The cord 22 may be rotatably mounted to resist an unintentional separation of the item from the holder by pivotally rotating when the wearer moves.

The hanger 14 can be securely affixed to the base member 10, which has been inserted into an article of clothing, preferably at the time the article of clothing is manufactured, using a closure 24, which in one embodiment can be rectangular and greater in size than the first throughhole 12 in the base member 10. In another embodiment, closure 24 can be shaped into substantially a clip shape.

Using cord 22, the hanger 14 is threaded through the article of clothing. It can be threaded through the first throughhole 12 in base member 10 and the cord 22 can be permanently secured using the aforementioned closure 24 to the base member 10. The cord 22 may have a sharp end, or can be looped through a needle to facilitate the perforation of a garment without damaging the fabric and to facilitate the threading through the base member 10. In one embodiment, the first throughhole 12 in the base member 10 may have the same diameter as the second throughhole 20 in the support base, and both throughholes may be slightly larger than the diameter of cord 22. The remaining cord 22 may be cut and discarded. Cord 22 may be wire, cable, line or twine. Suitable materials for cord 22 may be metal, plastic or fabric. The base member 10 may then be sewn into a fold in the fabric of the article of clothing, rendering it practically invisible. The loop 18 and support base 16 may be incorporated directly into an article of clothing, preferably at the time the article of clothing is manufactured.

From the foregoing, it is readily apparent that the holder described is extremely simple in construction, inexpensive to manufacture, and convenient for the user. A myriad of personal items can be securely supported in a manner that will resist the unintentional separation of the item from the holder. The holder may be suitably supported on any part of an article of clothing without damaging the fabric and may be readily adapted to the manner of the design of the garment as dictated by the manufacturer of the article of clothing. The holder described can be worn either in a vertical or horizontal position and may be placed in different positions (e.g., on a pocket, placket band, sleeve, collar or belt loop) on any article of clothing (e.g., a shirt, pair of pants or jacket).

Figure 3:
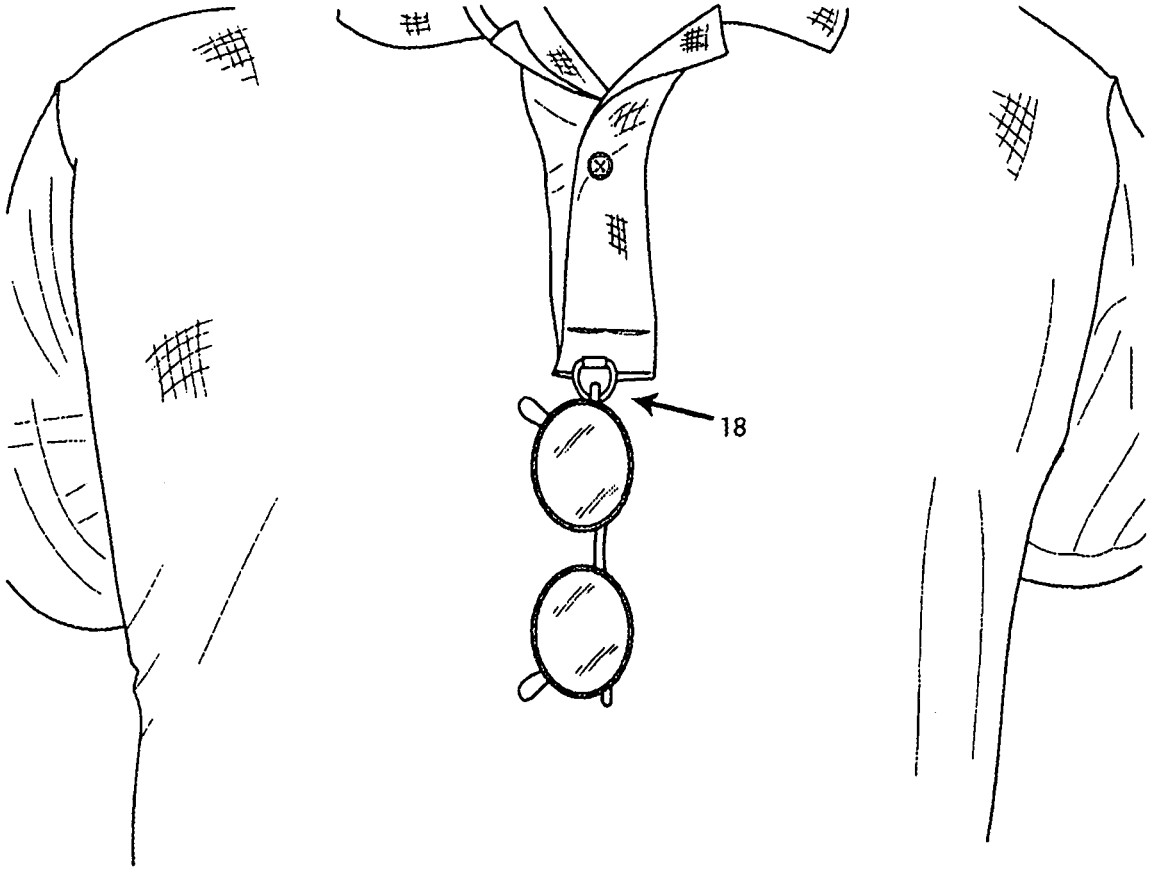
FIG. 3 shows a perspective view of one embodiment of the holder and eyeglasses supported therein according to the present invention.

FIG. 3 shows an embodiment as an eyeglass holder. The base 10 member is underneath the fold in the garment (within the rectangular area containing loop 18) and is not visible from either the front or the back because it is encompassed within the fold in the garment.

Although the present invention has been described with respect to a particular embodiment and illustrating an eyeglass holder as shown in FIG. 3, other alternative versions are possible, particularly those designed to hold sunglasses or other small personal items (e.g., a media player such as an iPOD or a mobile phone). Other variations could include those designed to affix to an article of clothing without the aforementioned base member 10 and cord 22, those intended to affix to an accessory (e.g., a handbag) that is not an article of clothing, or other adaptations using the same or substantially similar features. Therefore, the spirit and scope of the appended claims should not be limited to the description of the versions contained herein. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A holder for supporting a personal item comprising: a base member, a cord having a first end of the cord affixed to the base member; and a hanger comprising a loop and a support base connected to the loop, the support base being affixed to a second end of the cord, wherein the base member is adapted to be inserted into or attached on an article of clothing during manufacture of the article of clothing and the holder is adapted to support the personal item hanging thereon with the base member inserted into or attached on the article of clothing, wherein the base member has a first through hole there through and the first end of the cord is affixed to the base member with the first end of the cord traversed through the first through hole.

2. The holder of claim 1, further comprising a closure device affixed to the cord for preventing the cord from sliding out of the first through hole.

3. The holder of claim 1, wherein the base member is shaped to conform to a desired space in an article of clothing.

4. The holder of claim 1, wherein the base member is rectangular in shape.

5. The holder of claim 1, wherein said first through hole is located in any portion of said base member.

6. The holder of claim 1, wherein the support base comprises a resilient tubular ring or cylinder having a diameter greater than the loop.

7. The holder of claim 1, wherein the support base comprises transparent material or material of any color.

8. The holder of claim 1, wherein the loop is a covered fabric elastic loop having a diameter of about 0.1" to about 0.5" extending to about 0.25" to about 1.5" when fully extended.

9. The holder of claim 1, wherein the loop is made of formed resilient materials such as metal, fabric or plastic.

10. The holder of claim 1, wherein the loop comprises transparent material or material of any color.

11. The holder of claim 1, wherein the loop is formed to accommodate a temple piece of an eyeglass or a hook attached to another personal item.

12. The holder of claim 1, wherein the loop is shaped to resemble a manufacturer's logo or an ornamental shape.

13. The holder of claim 1, wherein the cord comprises metallic, plastic or fabric wire, cable, line or twine.

14. The holder of claim 1, wherein the base member comprises resilient fabric, plastic or metal material.

15. The holder of claim 1, wherein the support base comprises resilient fabric, plastic or metal material.

16. The holder of claim 1, wherein the support base is shaped to resemble a manufacturer's logo or other ornamental shape.

17. The holder of claim 1, wherein the base member comprises transparent material or material of any color.

18. The holder of claim 1, wherein the closure device is a knot or a rectangular object that is greater in size than the first through hole in the base member.

19. The holder of claim 1, wherein the closure device is shaped to resemble substantially a clip shape and is greater in size than the first through hole in the base member.

20. The holder of claim 1, wherein the base member has no through hole there through and the first end of the cord is affixed to the base member with the first end of the cord attached to the base member.

21. The holder of claim 1, wherein the hanger is designed to insert the personal item such that the personal item hangs from the hanger and assumes a flat position relative to the article of clothing.

22. A method of manufacturing a holder comprising a hanger comprising a loop and a support base connected to the loop, the method comprising:

affixing a first end of a cord to a base member;

affixing a second end of the cord to the support base; and affixing the base member into or on an article of clothing during manufacture of the article of clothing, wherein the loop is adapted to support a personal item thereon.

23. The method of claim 22, wherein providing a cord having a first end further comprises affixing a closure device to the cord.

24. The method of claim 22, further comprising affixing the cord via a through hole in said support base; passing said cord through an article of clothing; and securing said base member to said article of clothing.

25. The method of claim 22, wherein the cord or is looped with a needle through the article of clothing without damaging the article of clothing and facilitating threading through the base member.

26. The method of claim 22, wherein the affixing said first end of said cord to said base member comprises traversing the first end of said cord through a through hole in the base member.

27. The method of claim 22, wherein the affixing said first end of said cord to said base member comprises attaching the first end of said cord to the base member.

28. An article of clothing comprising a holder for supporting a personal item, the holder comprising a base member, a cord having a first end of the cord affixed to the base member; and a hanger comprising a loop and a support base connected to the loop, the support base being affixed to a second end of the cord, wherein the base member is adapted to be inserted into or attached on the article of clothing during manufacture of the article of clothing and the article of clothing is capable of supporting a weight of the personal item hanging from the holder with the base member inserted into or attached on the article of clothing.

29. The article of clothing of claim 28, wherein the base member has a first through hole there through and the first end of the cord is affixed to the base member with the first end of the cord traversed through the first through hole.

30. The article of clothing of claim 29, further comprising a closure device affixed to the cord for preventing the cord from sliding out of the first through hole.

31. The article of clothing of claim 28, wherein the base member is shaped to conform to a desired space in an article of clothing.

32. The article of clothing of claim 28, wherein the loop has a diameter of about 0.1" to about 0.5" extending to about 0.25" to about 1.5" when fully extended.

33. A holder for supporting a personal item comprising:

a base member, a cord having a first end of the cord affixed to the base member; and a hanger comprising a loop and a support base connected to the loop, the support base being affixed to a second end of the cord, wherein the base member is adapted to be inserted into or attached on an article of clothing during manufacture of the article of clothing and the holder is adapted to support the personal item hanging thereon with the base member inserted into or attached on the article of clothing, wherein the support base has a second through hole, the second through hole is centered lengthwise and crosswise on the support base and the cord passes through the second though hole in a direction substantially perpendicular the support base.

34. A holder for supporting a personal item comprising:

a base member, a cord having a first end of the cord affixed to the base member; and a hanger comprising a loop and a support base connected to the loop, the support base being affixed to a second end of the cord, wherein the base member is adapted to be inserted into or attached on an article of clothing during manufacture of the article of clothing and the holder is adapted to support the personal item hanging thereon with the base member inserted into or attached on the article of clothing, further comprising a resilient closure for securely affixing the base member to the hanger.

* * * * *

UNITED STATES PATENT AND TRADEMARK OFFICE

CERTIFICATE OF CORRECTION

PATENT NO. : 7,487,574 B2
APPLICATION NO. : 11/392560
DATED : February 10, 2009
INVENTOR(S) : Janice Lee-Holowka, Patricia Lee and Marc Lester It is certified that error appears in the above-identified patent and that said Letters Patent is hereby corrected as shown below:

In the Claims

Column 6, line 39
replace "of claim 1"
with -- of claim 2 --

Column 6, line 42
replace "of claim 1"
with -- of claim 2 --

Signed and Sealed this
Sixteenth Day of July, 2013

Teresa Stanek Rea
*Acting Director of the United States Patent and Trademark Office*